US005949455A

United States Patent [19]

Williams

[11] Patent Number: 5,949,455

[45] Date of Patent: Sep. 7, 1999

[54] METHOD OF PRINTING WITH A MULTI-NOZZLE CONTINUOUS INK JET PRINTER

[75] Inventor: John Lloyd Williams, Reading, United Kingdom

[73] Assignee: Domino Printing Sciences Plc, United Kingdom

[21] Appl. No.: 08/770,693

[22] Filed: Dec. 19, 1996

[30] Foreign Application Priority Data

Jan. 4, 1996 [GB] United Kingdom ..... 9600079

[51] Int. Cl.[6] ..... B41J 2/085; B41J 2/12

[52] U.S. Cl. ..... 347/76; 347/79

[58] Field of Search ..... 347/76, 74, 78, 347/79, 80, 82, 77

[56] References Cited

U.S. PATENT DOCUMENTS 4,347,519 8/1982 Kikuchi et al. .

5,049,899 9/1991 Dunand et al. ..... 347/76

FOREIGN PATENT DOCUMENTS 0104951 4/1984 European Pat. Off. .

OTHER PUBLICATIONS

Patent Abstracts of Japan vol. 8, No. 64 (M–285) [1501] Mar. 27, 1984.

*Primary Examiner*—N. Le

*Assistant Examiner*—Thien Tran

*Attorney, Agent, or Firm*—Lee, Mann, Smith, McWilliams, Sweeney & Ohlson

[57] ABSTRACT

A method of printing with a multi-nozzle continuous ink jet printer 1 that has a row of nozzles through which respective streams of ink 3 are emitted before being broken up into columns of droplets, a charge electrode assembly has a plurality of charge electrodes for charging individual droplets in each of the columns of droplets, deflection electrodes 5, 6 for deflecting charged droplets according to the charge thereon and an auxiliary charge electrode 8. A compensating charge is applied to all droplets in a chosen row by the auxiliary charge electrode causing differential deflection that allows drops from adjacent rows of droplets printed in alignment rather than offset from one another.

3 Claims, 4 Drawing Sheets

```
# # # # # # # # # # # #
```

FIG. 1

```
#   #   #   #   #   #   #
  #   #   #   #   #   #
```

FIG. 2

```
o + o + o + o + o + o + o + o + o +    - print even drops
- o - o - o - o - o - o - o - o - o    - print odd drops
o + o + o + o + o + o + o + o + o +    - print even drops
- o - o - o - o - o - o - o - o - o    - print odd drops
o + o + o + o + o + o + o + o + o +    - print even drops
- o - o - o - o - o - o - o - o - o    - print odd drops
```

FIG. 3

```
- + - + - + - + - + - + - + - + - +  corrected drops
- + - + - + - + - + - + - + - + - +  printed in a
- + - + - + - + - + - + - + - + - +  straight line
- + - + - + - + - + - + - + - + - +
```

FIG. 4

```
o + o + o + o + o + o + o + o + o +    - print even drops
- o - o - o - o - o - o - o - o - o    - print odd drops
o o o o o o o o o o o o o o o o o
o + o + o + o + o + o + o + o + o +    - print even drops
- o - o - o - o - o - o - o - o - o    - print odd drops
o o o o o o o o o o o o o o o o o
o + o + o + o + o + o + o + o + o +    - print even drops
- o - o - o - o - o - o - o - o - o    - print odd drops
o o o o o o o o o o o o o o o o o
```

FIG. 5

```
- + - + - + - + - + - + - + - + - +  corrected drops
- + - + - + - + - + - + - + - + - +  printed in a
- + - + - + - + - + - + - + - + - +  straight line
- + - + - + - + - + - + - + - + - +
```

FIG. 6

METHOD OF PRINTING WITH A MULTI-NOZZLE CONTINUOUS INK JET PRINTER

The present invention relates to multi-nozzle continuous ink jet printers and, more particularly, to the arrangement and use of charge electrodes for such printers.

Multi-nozzle continuous ink jet printers have been developed in order to provide high quality, high speed printing. A row of ink jet nozzles at very close spacings are provided and individual streams of ink issue from each of the nozzles continuously, being broken up into individual droplets automatically, and the individual droplets charged appropriately to cause them to be printed or else deflected into a gutter. Printers of this type are described, for example, in U.S. Pat. No. 4,613,871, U.S. Pat. No. 4,347,519 and U.S. Pat. No. 4,427,986. Such printers are generally known as binary continuous multi-jet ink jet printers.

The close spacing between nozzles and thus between individual droplets in the rows of droplets which are formed on break-up of the jets, results in so-called "crosstalk" between individual droplets due to the electrical charge imposed on the droplets by the charge electrodes. Various schemes have been devised in order to compensate for crosstalk, see the above U.S. patent specifications, in order to ensure high quality, ie. high definition, printing. A relatively simple technique for reducing crosstalk problems is to charge alternate droplets in each stream, thus providing a guard droplet between each pair of printable droplets. At the same time, guard droplets are provided between printable droplets in each row, so that every printable droplet has a guard droplet in front of it, behind it and to each side of it. The guard droplets pass into a gutter and are not printed. However, although such a scheme is effective in reducing unwanted crosstalk, the crosstalk compensation results in a staggering or offset between adjacent droplets on the printed substrate, which reduces printing quality. Thus, for example, an ideal straight line of printed drops becomes a sinuous line, thus creating fuzziness and reducing line definition.

The present invention sets out to mitigate for crosstalk compensation of this type.

According to the present invention there is provided a method of printing, using a multi-nozzle continuous ink jet printer which comprises a row of nozzles through which, in use, respective streams of ink are emitted before being broken up into droplets, a charge electrode assembly providing a plurality of respective charge electrodes for charging individual droplets in the streams, deflection electrodes for deflecting charged droplets according to the charge thereon, and an auxiliary charge electrode, the method comprising applying a compensating charge to all droplets in a chosen row via said auxiliary charge electrode causing differential deflection, to allow drops from adjacent rows of droplets to be printed in alignment rather than offset from one another.

By means of the auxiliary electrode, which acts on all droplet streams at once, the auxiliary charge can bring the droplets printed on to the printed substrate from one row, "back into line" with droplets in an immediately preceding or succeeding row.

One example of the apparatus and method of the present invention will now be described with reference to the accompanying drawings in which:

FIG. 1 illustrates, diagrammatically, ideal straight line printing of droplets, magnified many times;

FIG. 2 illustrates how the line becomes staggered due to crosstalk compensation by the insertion of guard drops between printable droplets;

Figure 7:
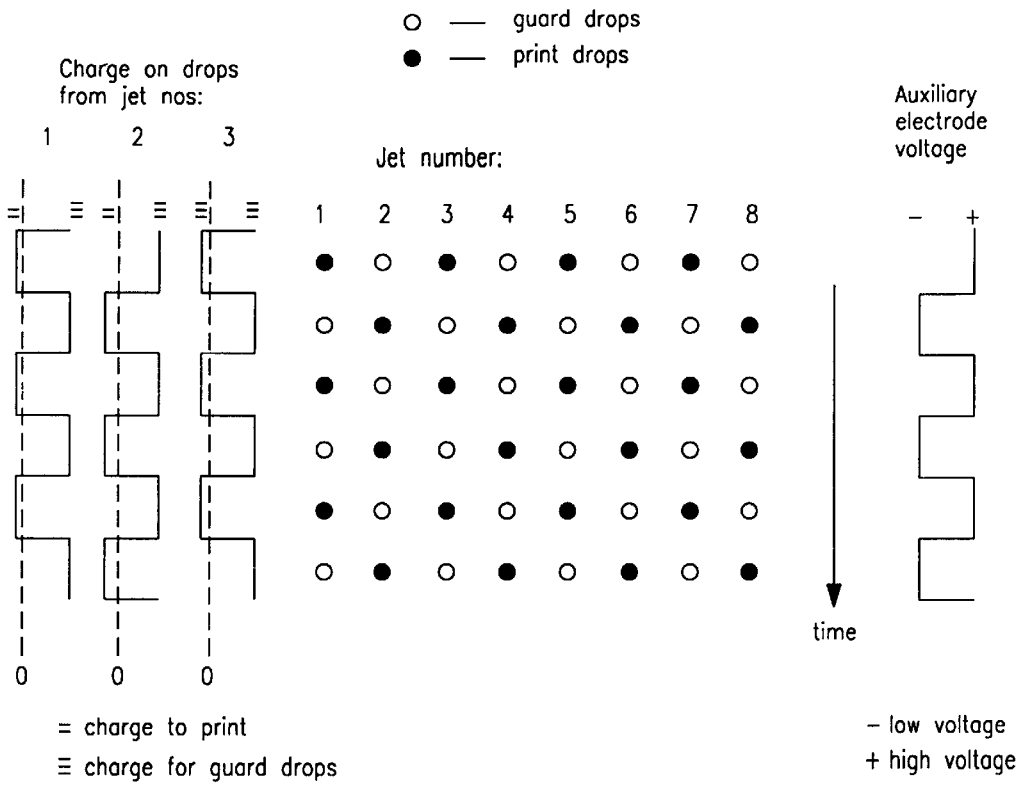
Figure 8:
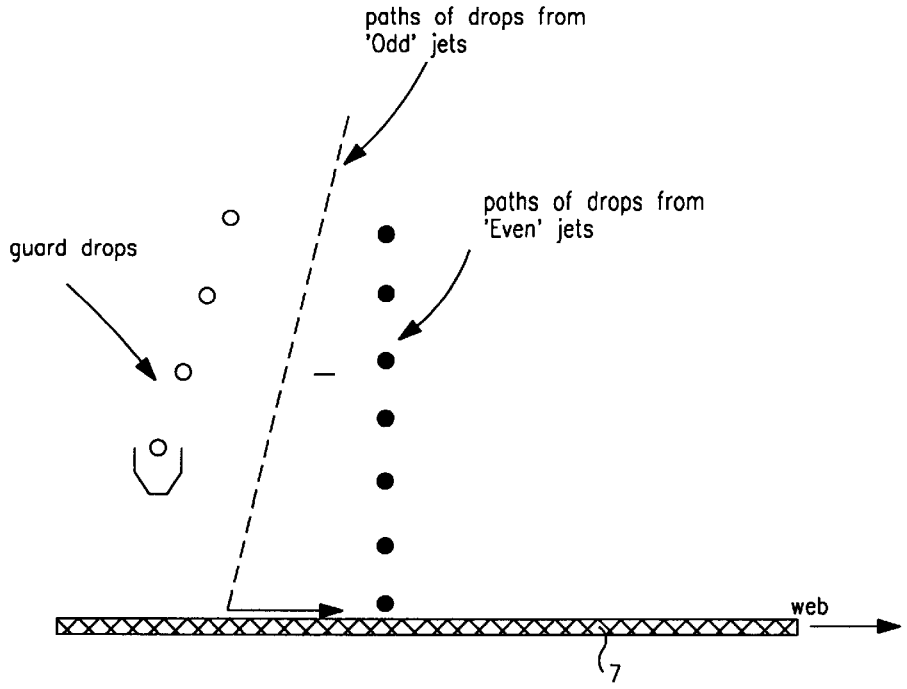
Figure 9:
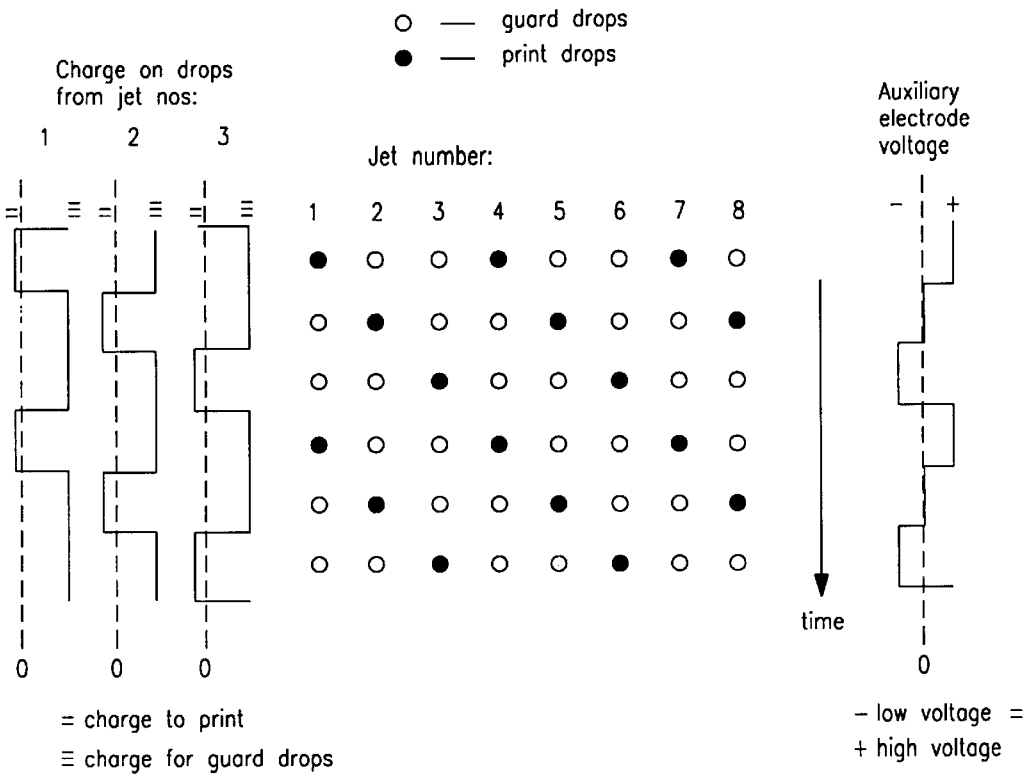
Figure 10:
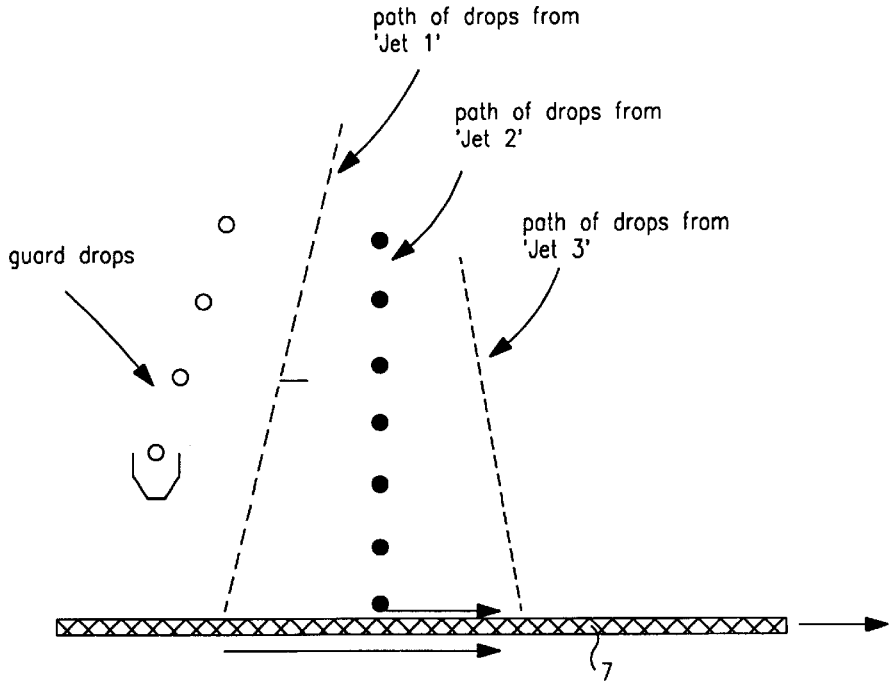
Figure 11:
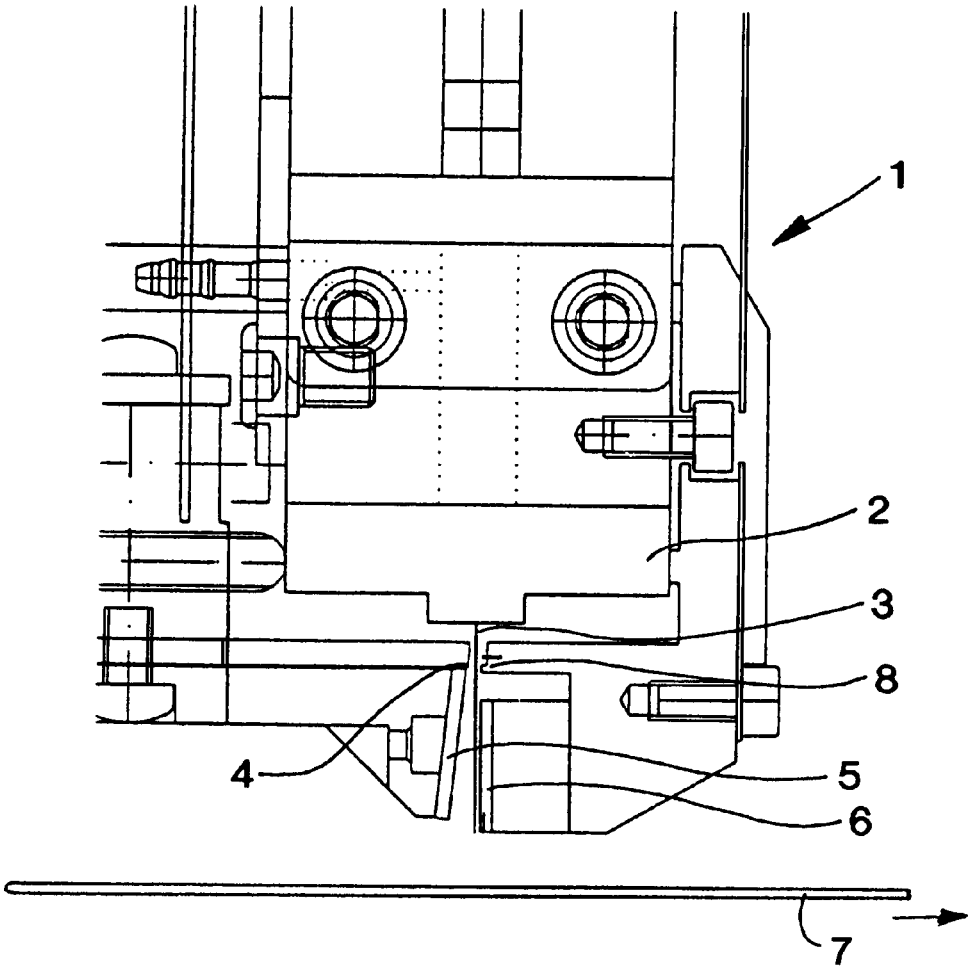

FIG. 3 provides an illustration of so-called odd and even droplets and their charging regimes;

FIG. 4 illustrates printing of droplets corrected by auxiliary electrode charging;

FIG. 5 illustrates a droplet charging regime for printing at lower speeds;

FIG. 6 illustrates the spacing of corrected droplets;

FIG. 7 illustrates the application of voltages on the charge electrodes and the auxiliary electrodes in use;

FIG. 8 illustrates the path of droplets to the substrate;

FIG. 9 illustrates an alternative charging strategy;

FIG. 10 illustrates the path of droplets according to the printing strategy of FIG. 9; and, FIG. 11 illustrates, in side view, the arrangement of the main print head components.

It is desirable that drops be capable of being printed from a multi-nozzle print head in a straight line as shown in FIG. 1, where the '#' symbols indicate the printed droplets. The line extends across the path of relative movement of the web or substrate and the print head. However, the problems of compensating for crosstalk result, as described above, in connection with U.S. Pat. No. 4,613,871 and U.S. Pat. No. 4,427,986, in a staggering of the printed droplets as shown in FIG. 2.

The method of the invention can be used to overcome this problem. The method proposed uses an auxiliary electrode to provide different charges on 'odd' and 'even' drops. This allows a different deflection to be given to odd and even drops. The difference in deflection allows drops which are charged at different times (crosstalk correction) to be printed in a straight line on the web as illustrated in FIGS. 3 & 4. In FIGS. 3 to 6, 'o' indicates a guard drop and '+' or '−' indicates a printed drop.

The auxiliary electrode (see FIG. 11) stretches across the whole width of the print head, and acts on all jets at once. During the period when odd drops are being printed, the auxiliary electrode is at a higher voltage than when even drops are being printed (see FIG. 7 for detail of the auxiliary electrode waveform). This has the effect of putting a different charge on odd and even drops. The charge is very small, as is the difference between odd and even charges. The result of the method is illustrated in FIG. 8.

If the web is moving at less than the maximum speed, then more drops will be produced than can be used for printing. These drops will be sent to the gutter. FIGS. 5 & 6 show the effect on printing. Slowing the printing rate places rows of gutter drops between the rows of printed drops, but has no effect on the appearance of the printed result. When the print head is printing "full black" (using all available drops) at full speed, only the guard drops go to the gutter; there are no complete rows of unprinted drops.

The preceding discussion refers to the use of one guard drop in between each printed drop. This concept can be extended to the use of two guard drops between each printed drop. FIGS. 9 & 10 show (similarly to FIG. 7 & 8) how a 3-phase drive to the auxiliary electrode can be used to correct for the effect of the guard drops. FIG. 11 illustrates, in side view, a print head used in the method according to the present invention. The print head 1 has a nozzle plate 2 from which, in use, are emitted streams of droplets in the plane indicated by the line 3. A row of charge electrodes 4 are provided close to the side of the plane of the streams of droplets so that individual drops in the streams can be electrostatically charged (as well known in the art). Guard drops are generated as required and passed in use into a gutter (not shown). A pair of deflector plates (or electrodes) 5, 6 are held, in use, at an appropriate voltage so that charge droplets are deflected in the electric field generated across the electrodes 5, 6 and are deposited onto the substrate 7 moving beneath the print head.

In order to carry out the method of the invention the apparatus includes a single auxiliary electrode 8 which extends the entire width of the jets of ink and voltages are applied to the auxiliary electrode 8 as described above.

I claim:

1. A method of printing with a multi-nozzle continuous ink jet printer that has charge electrodes, deflection electrodes, and an auxiliary charge electrode comprising:

emitting from each nozzle a column of droplets, forming a plurality of rows of droplets from droplets in each column, selectively charging each row of droplets, applying a compensating charge to all droplets in a chosen row by said auxiliary charge electrode to provide differential deflection, wherein drops from adjacent rows of droplets are printed in alignment rather than offset from one another.

2. A method according to claim 1 which comprises applying a different compensating charge to 'odd' and 'even' droplets.

3. A method according to claim 1 which comprises applying differing compensating charges to adjacent rows of droplets by means of a 3-phase drive to the auxiliary electrode.

* * * * *